US011305321B2

(12) United States Patent
Chen et al.

(10) Patent No.: US 11,305,321 B2
(45) Date of Patent: Apr. 19, 2022

(54) HYDRAULIC FORMING MACHINE AND METAL BALL FORMING MACHINE

(71) Applicant: XI'AN METALWK HYDRAUMATIC MACHINERY CO., LTD., Shaanxi (CN)

(72) Inventors: Shixiong Chen, Shaanxi (CN); Yanjuan Wang, Shaanxi (CN); Zhenzhong Wang, Shaanxi (CN); Shujuan Tang, Shaanxi (CN); Jian Yang, Shaanxi (CN); Chun Yin, Shaanxi (CN); Xiaodong Wu, Shaanxi (CN); Dan Wu, Shaanxi (CN); Jingyun Zhao, Shaanxi (CN); Haiyan Liu, Shaanxi (CN); Xiaohui Ji, Shaanxi (CN)

(73) Assignee: XI'AN METALWK HYDRAUMATIC MACHINERY CO., LTD., Xi'an (CN)

( * ) Notice: Subject to any disclaimer, the term of this patent is extended or adjusted under 35 U.S.C. 154(b) by 45 days.

(21) Appl. No.: 16/435,488

(22) Filed: Jun. 8, 2019

(65) Prior Publication Data

US 2019/0321872 A1 Oct. 24, 2019

Related U.S. Application Data

(63) Continuation of application No. PCT/CN2017/115306, filed on Dec. 8, 2017.

(30) Foreign Application Priority Data

Dec. 9, 2016 (CN) ..... 201611132622.5
Dec. 8, 2017 (CN) ..... 201710852159.X

(51) Int. Cl.
*B21C 23/18* (2006.01)
*B21C 31/00* (2006.01)
(Continued)

(52) U.S. Cl.
CPC ..... *B21C 23/18* (2013.01); *B21C 31/00* (2013.01); *B30B 1/32* (2013.01); *B30B 15/16* (2013.01)

(58) Field of Classification Search
CPC ..... B21C 23/14; B21C 23/18; B21C 31/00; B21C 35/02; B21C 35/04; B21C 37/00;
(Continued)

(56) References Cited

U.S. PATENT DOCUMENTS 1,857,997 A * 5/1932 Brennan ..... B21K 27/06 72/337
1,897,359 A * 2/1933 Brennan ..... B21K 1/02 72/337
(Continued)

FOREIGN PATENT DOCUMENTS

CN 1396314 A 2/2003
CN 202129625 U 2/2012
(Continued)

*Primary Examiner* — Gregory D Swiatocha
*Assistant Examiner* — Bobby Yeonjin Kim

(57) ABSTRACT

A hydraulic forming machine, including a body provided with a feed inlet penetrating a first mounting surface, a cutting mechanism, a forming die, an ejector arranged on the forming die, and a driving mechanism. The forming die includes a movable die and a fixed die matched with each other. The cutting mechanism and the fixed die are provided on the first mounting surface of the body and respectively at two sides of the discharge end of the feed inlet. The movable die is arranged on the driving mechanism and driven by the driving mechanism to move close to or away from the fixed die in a direction perpendicular to the first mounting surface. The cutting mechanism is configured to cut a blank at an output end of the conveying inlet. The blank cut by the cutting mechanism is extruded between the fixed die and the movable die.

5 Claims, 5 Drawing Sheets

(51) Int. Cl.
*B30B 1/32* (2006.01)
*B30B 15/16* (2006.01)

(58) Field of Classification Search
CPC ... B21D 35/001; B21J 5/00; B21J 5/02; B21J 5/027; B21K 1/02; B23D 33/08; B23P 23/06; B30B 1/32; B30B 9/326; B30B 15/16; B30B 15/26
USPC ..... 72/254, 255, 337, 339
See application file for complete search history.

(56) References Cited

U.S. PATENT DOCUMENTS 2,315,769 A * 4/1943 Carney ..... B21J 9/18 470/137
2,800,814 A * 7/1957 Lewis, Jr. ..... B21K 1/02 72/339
3,972,216 A * 8/1976 Messerschmidt ..... B21J 9/18 72/337
4,023,393 A * 5/1977 Messerschmidt ..... B21J 9/02 72/337
4,761,980 A * 8/1988 Kawashima ..... B21D 43/021 470/17
5,660,073 A * 8/1997 McBroom ..... B21K 1/02 72/294
5,799,573 A * 9/1998 Levy ..... B30B 1/08 100/271
2016/0101476 A1* 4/2016 Yamauchi ..... B23D 27/00 83/22

FOREIGN PATENT DOCUMENTS

CN 105799201 A * 7/2016 ..... B30B 9/326
CN 106739124 A 5/2017
CN 107377654 A 11/2017
CN 107617884 A 1/2018
JP H09141379 A 6/1997

* cited by examiner

HYDRAULIC FORMING MACHINE AND METAL BALL FORMING MACHINE

CROSS-REFERENCE TO RELATED APPLICATIONS

This application is a continuation of International Patent Application No. PCT/CN2017/115306, filed on Dec. 8, 2017, which claims the benefit of priority from Chinese Application No. 201611132622.5, filed on Dec. 9, 2016 and Chinese Application No. 201710852159.X, filed on Sep. 19, 2017. The content of the aforementioned applications, including any intervening amendments thereto, are incorporated herein by reference.

TECHNICAL FIELD

The present disclosure relates to metal forming equipments, and more particularly to a hydraulic forming machine and a metal ball forming machine.

BACKGROUND OF THE INVENTION

At present, phosphor copper balls are widely applied to most of the anode materials for electroplating in the electronic circuit board processing industry and the copperplate printing industry. The phosphor copper balls are generally formed by mechanical methods, including mechanical rolling and mechanical press forming.

The copper ball produced by mechanical rolling is generally small in diameter, and coarse and uneven in the internal grain structure, and has a poor compactness and brightness on the surface and a low quality. The rolling yield is about 75-82%, which requires a large number of labors to pick out the defective products on the product line. Meanwhile, the rollers have a short service life and a high cost. The rolling equipment produces large vibration and noise which is out of the limit.

The mechanical press forming adopts mechanical transmission and has a small forming force, such that the specifications of the copper ball products are limited. The higher pair transmissions are adopted in transmission mechanism, such that the mechanical wear is serious and the spare parts cost is high. Moreover, the movement mechanism clearance can not be automatically compensated, such that the equipment movement parameters are unstable after the mechanical wear, which results the unstable quality of the copper balls and reduces the yield and the production efficiency. The equipment is jammed or even damaged in severe cases. The press forming equipment has a complex structure and requires extensive maintenance, resulting in high maintenance cost and outage factor. Further, the press forming equipment also produces too much noise and vibration, which is not environment-friendly.

SUMMARY OF THE INVENTION

An object of the present disclosure is to provide a hydraulic forming machine, which adopts extrusion forming and has the functions of shearing, extrusion, ejecting and receiving, and can directly extrude the blank after being cut. The product quality and production yield can be improved. The service life of tools and molds can be extended, and the costs for replacement and use are reduced. The equipment's operation reliability and continuous operation capability are improved. The failure rate, maintenance workload and skill requirements of workers for maintenance are reduced. The costs of spare parts and maintenance are saved. The noise during operation is reduced and the working environment is improved.

Another object of the present disclosure is to provide a metal ball forming machine to improve product quality and work efficiency.

A hydraulic forming machine, including a body, a cutting mechanism, a forming die, an ejector and a driving mechanism. The body is provided with at least one first mounting surface. The forming die includes a movable die and a fixed die matched with the movable die. The ejector includes a first ejecting component arranged at a side of the movable die and a second ejecting component arranged at a side of the fixed die.

The body is provided with a feed inlet penetrating the first mounting surface. The cutting mechanism and the fixed die are provided on the first mounting surface of the body and at two sides of the discharge end of the feed inlet. The movable die is arranged on the driving mechanism and driven by the driving mechanism to move close to or away from the fixed die in a direction perpendicular to the first mounting surface. A blank cut by the cutting mechanism is extruded between the fixed die and the movable die.

The blank enters through the feed inlet of the body. The blank at the discharge end of the feed inlet is cut by the cutting mechanism on the side of the feed inlet and transported to the fixed die. The movable die moves close to the fixed die under the action of the driving mechanism and extrudes the cut blank by matching with the fixed die to complete an extruding. The movable die moves away from the fixed die under the action of the driving mechanism. At the same time, the first ejecting component and the second ejecting component simultaneously operate to eject the extruded product from between the fixed die and the movable die. The extruded product falls to the receiving device by gravity and is collected by the receiving device, such that a forming is finished.

Optionally, the driving mechanism includes a main hydraulic cylinder. The body is provided with at least one second mounting surface parallel to the first mounting surface. The main hydraulic cylinder is provided on the second mounting surface of the body. An axis of a piston rod of the main hydraulic cylinder is perpendicular to the second mounting surface. An end of the piston rod of the main hydraulic cylinder faces the first mounting surface. The movable die is arranged on the end of the piston rod of the main hydraulic cylinder.

Optionally, the driving mechanism further includes a slide component arranged between the first mounting surface and the second mounting surface. The slide component includes a slide block, a first rail and a second rail. Two sides of the slide block are respectively slidably engaged with the first rail and the second rail. The piston rod of the main hydraulic cylinder is connected to one end of the slide block, the movable die and the first ejecting component are arranged on the other end of the slide block.

Optionally, the body is configured for the mounting of all of the cutting mechanism, the forming die, the ejector, the slide block, and the main hydraulic cylinder.

Optionally, the cutting mechanism includes a cutting drive device, a shear, a cutting die, a clamp and a clamp drive device. The shear is provided with a shear blade, and the clamp is provided with a clamping portion.

The cutting die is provided on the first mounting surface and provided with a conveying inlet arranged concentrically with the feed inlet. A processing space is provided at an output end of the conveying inlet. The shear is driven by the cutting drive device to reciprocate in a plane perpendicular to the axis of the conveying inlet, the clamping portion of the clamp is driven by the clamp drive device to move close to or away from the shear blade. The clamping portion of the clamp and the shear blade of the shear are driven by the clamp drive device to clamp the blank in the processing space and synchronously move to a position between the fixed die and the movable die for extruding the blank.

Optionally, the cutting drive device includes a guide mechanism and a cutting slide block. The guide mechanism is provided on the first mounting surface and at a side of the cutting die. A guiding direction of the guide mechanism is perpendicular to an extending direction of the axis of the conveying inlet. The cutting slide block is slidably engaged with the guide mechanism. The shear is arranged at a side close to the cutting die.

Optionally, the cutting drive device further includes a cutting hydraulic cylinder. An end of the cutting slide block away from the cutting die is connected to a piston rod of the cutting hydraulic cylinder.

Optionally, the clamp is further provided with a swinging pivot and a drive end. The swinging pivot is hinged to an end of the cutting slide block. The shear is arranged on the end of the cutting slide block. The drive end is connected to the clamp drive device. The clamp is driven by the clamp drive device to reciprocate about the swing pivot and move with the shear slide block.

Optionally, the hydraulic forming machine further includes a hydraulic control system and an electrical control system.

Optionally, the hydraulic forming machine further includes a receiving device arranged at a side of the first mounting surface and under the fixed die.

A metal ball forming machine, comprising a feed device, a clamping device, a straightening device, a fixed-length feed device, a mainframe, a blank cutting device, a copper ball forming die device, a ball ejector, a slide component, and a hydraulic power device, the ball receiving device, a hydraulic control system and an electric control system. The copper ball is formed by the metal ball forming machine by using a hydraulic power.

The invention has the following beneficial effects. The hydraulic forming machine provided by the present application has the functions of cutting, extrusion forming, ejection and receiving, and can directly extrude the blank after being cut. All the motions can be completed in one time on the hydraulic forming machine.

BRIEF DESCRIPTION OF THE DRAWINGS

In order to more clearly illustrate the technical solutions of the embodiments of the present invention, the drawings used in the embodiments will be briefly described below. It should be understood that the following drawings only show certain embodiments of the present invention and should not limit the scope. Those skilled in the art can obtain other related figures according to these drawings without any creative work.

REFERENCE NUMERALS

Figure 1:
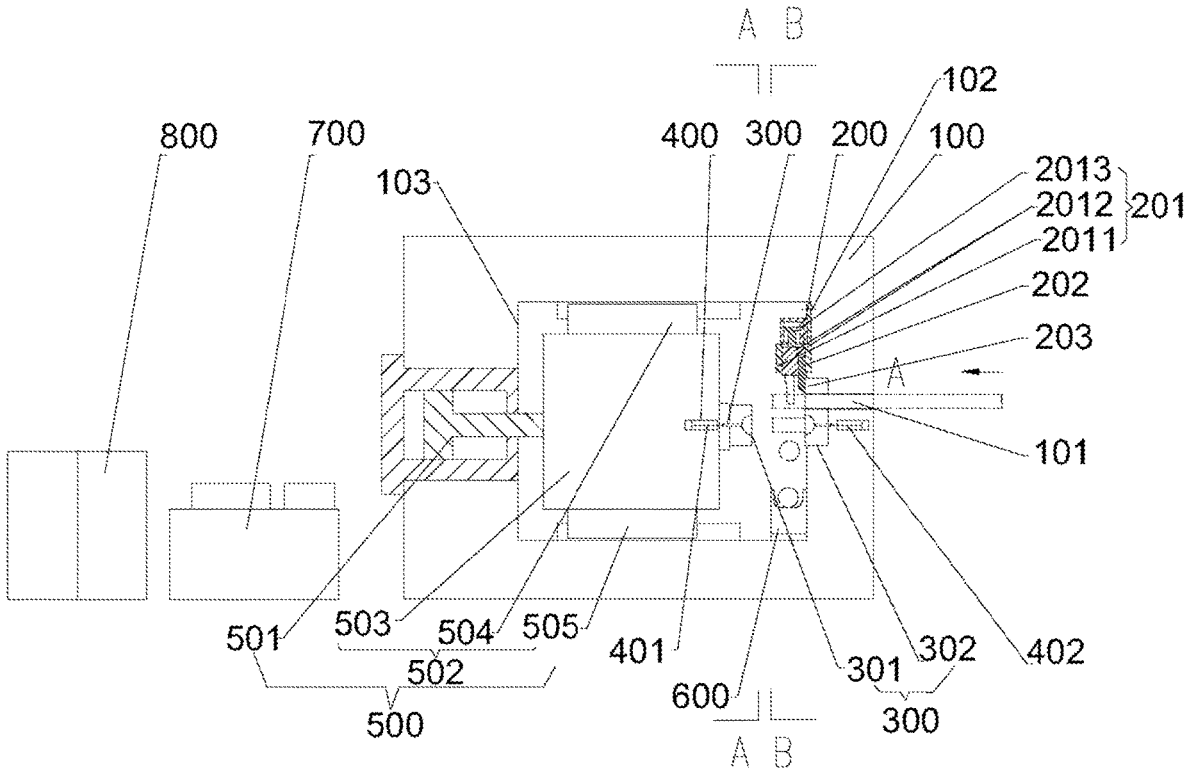
FIG. 1 is a schematic diagram showing a hydraulic forming machine according to an embodiment of the present invention.

100, body; 200, cutting mechanism; 300, forming die; 400, ejector; 500, driving mechanism; 101, feed inlet; 102, first mounting surface; 103, second mounting surface; 201, cutting drive device; 202, shear; 203, cutting die; 204, clamp; 205, clamp drive device; 2011, guide mechanism; 2012, cutting slide block; 2013, cutting hydraulic cylinder; 2021, shear blade; 2031, conveying inlet; 2041, clamping portion; 2042, swinging pivot; 2043, drive end; 301, movable die; 302, fixed die; 401, first ejecting component; 402, second ejecting component; 501, main hydraulic cylinder; 502, slide component; 503, slide block; 504, first rail; 505, second rail; 600, receiving device; 700, hydraulic control system; 800, electrical control system.

DETAILED DESCRIPTION OF EMBODIMENTS

In order to more clearly illustrate the objects, technical solutions and merits of the embodiments of the present invention, the technical solutions will be clearly and completely described below with reference to the accompanying drawings. A part of embodiments rather than all of the embodiments of the invention are described. The components in the embodiments of the invention, which are generally described and illustrated in the drawings herein, may be arranged and designed in various different configurations.

Therefore, the following detailed description of the embodiments of the invention is not intended to limit the claimed protection scope of the present invention, but merely represents selected embodiments of the invention. All other embodiments obtained by those skilled in the art based on the embodiments of the present invention without creative efforts are within the protection scope of the present invention.

It should be noted that similar reference numerals and letters indicate similar items in the following drawings. Therefore, once an item is defined in a drawing, it is not necessary to be further defined and explained in the subsequent drawings.

In the description of the present invention, it should be noted that the terms "first", "second", etc. are used only to distinguish the elements, and are not to be construed as indicating or implying the relative importance.

In the description of the present invention, it should also be noted that the terms "set", "install", and "connection" should be understood broadly, unless otherwise specified and defined. For example, "connection" may be a fixed connection, a detachable connection or an integral connection. It may be a mechanical connection or an electrical connection. It may be directly connected, or indirectly connected through an intermediate medium, and may be internal communication between two elements. The specific meaning of the above terms in the present invention can be understood in a specific case by those skilled in the art.

Embodiment 1

Referring to FIGS. 1-9, the hydraulic forming machine of the present embodiment is used for hydroforming metal balls including copper balls, iron balls, etc. Phosphor copper balls are processed and formed by the hydraulic forming machine in the present embodiment.

Figure 2:
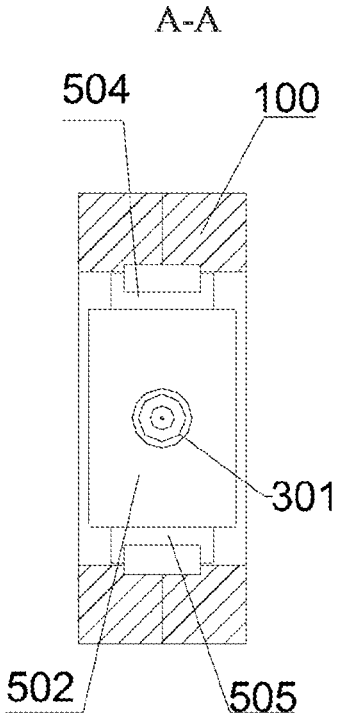
FIG. 2 is a sectional view taken along A-A of FIG. 1.
Figure 3:
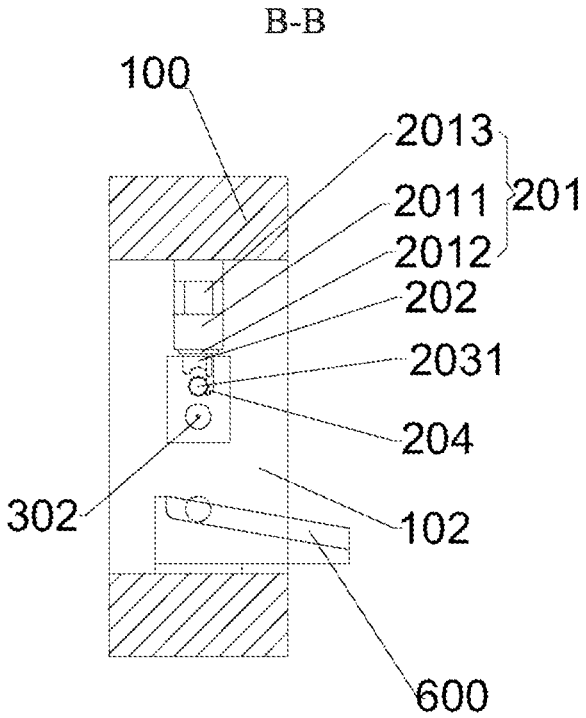
FIG. 3 is a sectional view taken along B-B of FIG. 1.

As shown in FIG. 1, the hydraulic forming machine of the present embodiment includes a body 100, a cutting mechanism 200, a forming die 300, an ejector 400, and a driving mechanism 500. The body 100 is provided with at least one first mounting surface 102. As shown in FIGS. 2-3, the forming die 300 includes a movable die 301 and a fixed die 302 matched with the movable die 301. The ejector 400 includes a first ejecting component 401 arranged on a side of the movable die 301 and a second ejecting component 402 arranged at a side of the fixed die 302.

The body 100 is provided with a feed inlet 101 penetrating the first mounting surface 102. The cutting mechanism 200 and the fixed die 302 are provided on the first mounting surface 102 of the body 100 and separately at two sides of a discharge end of the feed inlet 101. The movable die 301 is arranged on the driving mechanism 500. The driving mechanism 500 is able to drive the movable die 301 to move close to or away from the fixed die 302 in a direction perpendicular to the first mounting surface 102. A blank cut by the cutting mechanism 200 enters a space between the fixed die 302 and the movable die 301 for extruding the blank.

The blank enters through the feed inlet 101 of the body 100. The blank at the discharge end of the feed inlet 101 is cut by the cutting mechanism 200 on the side of the feed inlet 101. As shown in FIGS. 6-9, in the cutting process, when the shear blade 2021 is in contact with the blank, the clamping portion 2041 tightly presses the blank to clamp the blank together with the shear blade 2021. When the cutting is finished, the centerline of the blank coincides with that of the fixed die 302. In such a way, the blank is transported to the fixed die 302. The movable die 301 moves close to the fixed die 302 under the action of the driving mechanism 500 and extrudes the cut blank by matching with the fixed die 302 to complete the extruding. The movable die 301 moves away from the fixed die 302 under the action of the driving mechanism 500. At the same time, the first ejecting component 401 and the second ejecting component 402 move relative to each other to eject the extruded product from the fixed die 302 or the movable die 301, regardless of whether the product is bonded in the movable die 301 or in the fixed die 302. The extruded product falls to the receiving device 600 by gravity and is collected by the receiving device 600, such that a forming is finished.

The cutting motion is completed by the cutting mechanism 200. The extrusion forming motion is completed by the forming die 300. The ejection motion is completed by the ejector 400. The cut blank is directly extruded after the cutting is finished. All the motions are completed at one time on the hydraulic forming machine, thereby simplifying the process and improving product quality and productivity.

It should be noted that: 1. in this embodiment, the body 100 adopts a vertical closed frame structure; 2. the cross-sectional shapes of the blank include a circle, a triangle, a polygon and an irregular shape, and the cross-sectional shape of the blank in the present embodiment is a circle; 3. the product of the present technical solution may be a ball, a cylinder, a long cylinder, a triangular prism, a polygonal prism, an irregular body, and the product in the present embodiment is a ball; 4. "at least one first mounting surface 102" means that it may be arranged one, two or more first mounting surfaces 102, and a plurality of first mounting surfaces 102 are parallel to each other, and the fixed die 302 and the cutting mechanism 200 can be arranged on different first mounting surfaces 102.

As shown in FIG. 1, the driving mechanism 500 includes a main hydraulic cylinder 501. The body 100 is provided with at least one second mounting surface 103 parallel to the first mounting surface 102. The main hydraulic cylinder 501 is provided on the second mounting surface 103 of the body 100. An axial line of a piston rod of the main hydraulic cylinder 501 is perpendicular to the second mounting surface 103. An end of the piston rod of the main hydraulic cylinder 501 faces the first mounting surface 102. The movable die 301 is arranged on the end of the piston rod of the main hydraulic cylinder 501.

The driving mechanism 500 adopts a hydraulic cylinder. When the piston rod of the main hydraulic cylinder 501 reciprocates in a direction perpendicular to the second mounting surface 103, the movable die 301 is driven to move close to or away from the fixed die 302 in the direction perpendicular to the second mounting surface 103. After the blank is cut, it directly enters a space in the centerline of the fixed die 302 and the movable die 301. The movable die 301 moves close to the fixed die 302 to clamp, compress and extrude the blank, realizing hydroforming the product.

It should be noted that "at least one second mounting surface 103" means that one, two or more second mounting surfaces 103 may be arranged, and the plurality of second mounting surfaces 103 are parallel to each other and components arranged on the second mounting surface 103 may be arranged on different second mounting surfaces 103.

As shown in FIG. 1, the driving mechanism 500 further includes a slide component 502 arranged between the first mounting surface 102 and the second mounting surface 103. The slide component 502 includes a slide block 503, a first rail 504, and a second rail 505. Opposite sides of the slide block 503 are respectively slidably engaged with the first rail 504 and the second rail 505. The piston rod of the main hydraulic cylinder 501 is connected to one end of the slide block 503. The movable die 301 and the first ejecting component 401 are arranged on the other end of the slide block 503.

The first rail 504 and the second rail 505 limit the slide block 503 to move only in the direction perpendicular to the second mounting surface 103. The reciprocating movement of the piston rod of the main hydraulic cylinder 501 can drive the slide block 503 to reciprocate along the first rail 504 and the second rail 505, and the slide block 503 drives the movable die 301 to move close to or away from the fixed die 302, thereby completing the extrusion forming of the blank.

As shown in FIG. 1, the body 100 is adapted to mount all of the cutting mechanism 200, the forming die 300, the ejector 400, the slide block 503 and the main hydraulic cylinder 501.

As shown in FIG. 1, the hydraulic forming machine further includes a hydraulic control system 700 and an electrical control system 800.

A cutting hydraulic cylinder 2013 and the main hydraulic cylinder 501 are both driven by the hydraulic control system 700. The hydraulic control system 700 may adopt hydraulic proportional control or hydraulic servo control technology under the required working conditions, which can steplessly adjust the extrusion forming force, the extrusion forming speed, the cutting force and the cutting speed so as to improve the quality of the product. The hydraulic control system 700 is arranged on a side of the body 100 and connected to the cutting hydraulic cylinder 2013 and the main hydraulic cylinder 501 on the body 100 through hydraulic tubing. It should be noted that the electro-hydraulic position closed-loop control technology is adopted in the extrusion forming stroke and the cutting stroke of the hydraulic forming machine.

As shown in FIG. 3, the hydraulic forming machine further includes a receiving device 600 provided on a side of the first mounting surface 102 and under the fixed die 302.

The movable die 301 moves close to the fixed die 302 under the action of the driving mechanism 500 and extrudes the cut blank by matching with the fixed die 302 to complete the processing. The movable die 301 is moved away from the fixed die 302 by the driving mechanism 500. At the same time, the first ejecting component 401 and the second ejecting component 402 simultaneously move relative to each other to eject the extruded product from the fixed die 302 or the movable die 301, regardless of whether the product is bonded in the movable die 301 or in the fixed die 302. The extruded product falls to the receiving device 600 by gravity, such that a forming is finished.

Figure 4:
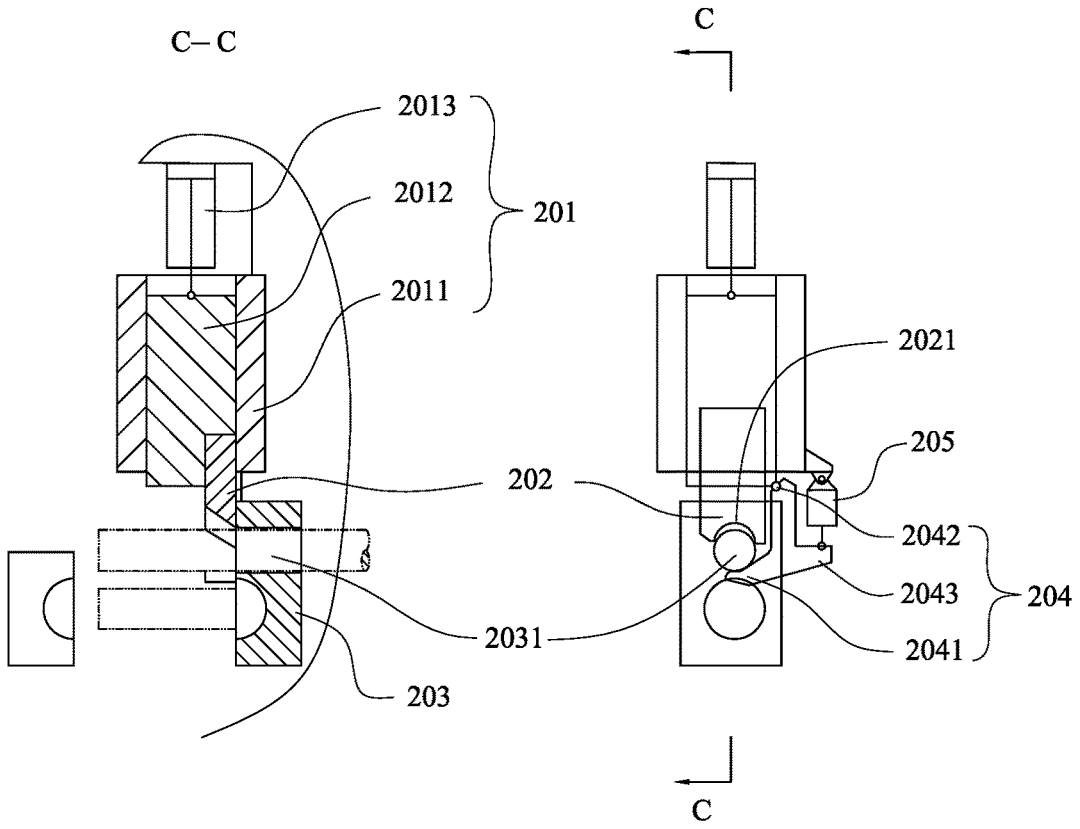
FIG. 4 is a schematic diagram showing a cutting mechanism of the hydraulic forming machine according to an embodiment of the present invention.

As shown in FIG. 4, the cutting mechanism 200 includes a cutting drive device 201, a shear 202, a cutting die 203, a clamp 204, and a clamp drive device 205. The shear 202 is provided with a shear blade 2021, and the clamp 204 is provided with a clamping portion 2041.

The cutting die 203 is provided on the first mounting surface 102 and provided with a conveying inlet 2031 arranged concentrically with the feed inlet 101. An output end of the conveying inlet 2031 is provided with a processing space. The shear 202 is driven by the cutting drive device 201 to reciprocate in a plane perpendicular to an axis of the conveying inlet 2031. The clamping portion 2041 of the clamp 204 is driven by the clamp drive device 205 to move close to or away from the shear blade 2021. The clamping portion 2041 of the clamp 204 and the shear blade 2021 of the shear 202 are driven by the clamp drive device 205 to clamp the blank in the processing space and synchronously move the blank to the space in the centerline between the fixed die 302 and the movable die 301, and the blank is extruded by the movable die 301.

When the cutting begins, a distance is left between the shear blade 2021 of the shear 202 and the conveying inlet 2031 in a moving direction of the shear 202. The clamping portion 2041 of the clamp 204 is at a position away from the shear blade 2021 of the shear 202. The blank passes through the conveying inlet 2031 from the feed inlet 101 of the body 100 and then enters the processing space and stops when it is moved a distance of a fixed length. The cutting drive device 201 drives the shear 202 to reciprocate and pass through the processing space. When the cutting drive device 201 drives the shear 202 to move toward the processing space, the clamp drive device 205 drives the clamping portion 2041 of the clamp 204 to move close to the shear blade 2021 until the blank is clamped by the shear blade 2021 and the clamping portion 2041. The cutting drive device 201 and the clamp drive device 205 respectively drive the shear 202 and the clamp 204 to synchronously move to the centerline between the fixed die 302 and the movable die 301 and shear the blank during the moving. The movable die 301 moves close to the fixed die 302 under the action of the driving mechanism 500 and extrudes the cut blank by matching with the fixed die 302 to complete the processing.

As shown in FIG. 4, the cutting drive device 201 includes a guide mechanism 2011 and a cutting slide block 2012. The guide mechanism 2011 is provided on the first mounting surface 102 and at a side of the cutting die 203. A guiding direction of the guide mechanism 2011 is perpendicular to an extending direction of the axis of the conveying inlet 2031. The cutting slide block 2012 is slidably engaged with the guide mechanism 2011. The shear 202 is arranged at an end of the cutting slide block 2012 close to the cutting die 203.

The cutting slide block 2012 is slidably arranged on the guide mechanism 2011. The cutting slide block 2012 can only move along the direction perpendicular to the axis of the conveying inlet 2031 under the action of the guide mechanism 2011. The cutting slide block 2012 drives the shear 202 to effectively shear the blank conveyed from the conveying inlet 2031.

As shown in FIG. 4, the cutting drive device 201 further includes a cutting hydraulic cylinder 2013. An end of the cutting slide block 2012 away from the cutting die 203 is connected to the piston rod of the cutting hydraulic cylinder 2013.

The cutting drive device 201 may adopt manners of a hydraulic cylinder driving, an pneumatic cylinder driving, a mechanical driving, an electric-mechanical driving, an electromagnetic driving, a cam lever and spring driving, a blank impact and a spring returning. The present embodiment adopts a hydraulic cylinder driving manner. The piston rod of the cutting hydraulic cylinder 2013 reciprocates and drives the cutting slide block 2012 to reciprocate along the guide mechanism 2011.

As shown in FIG. 4, the clamp 204 is further provided with a swinging pivot 2042 and a drive end 2043. The swinging pivot 2042 is hinged to an end of the cutting slide block 2012 provided with the cutting shear 202. The drive end 2043 is connected to the clamp drive device 205. The clamp drive device 205 drives the clamp 204 to swing around the swing pivot 2042 and moves with the shear slide block 2012.

The clamp 204 and the shear 202 are arranged at the same end of the cutting slide block 2012. The cutting slide block 2012 reciprocates to drive the shear 202 to reciprocate. The clamping portion 2041 can move close to or away from the shear blade 2021 of the shear 202 when the clamp drive device 205 drives the clamp 204 to reciprocate around the swinging pivot 2042. When the clamping portion 2041 moves close to the shear blade 2021, the clamping portion 2041 together with the shear blade 2021 clamp the blank in the processing space. Then the cutting slide block 2012 drives the shear 202 to move towards the centerline of the movable die 301 and the fixed die 302 while the relative positions of the shear 202 and the clamp 204 are unchanged. The clamp drive device 205 also drives the clamp 204 to move synchronously with the shear 202, and the blank is cut during the movement. The cut blank is placed on the centerline between the fixed die 302 and the movable die 301. The movable die 301 moves close to the fixed die 302 by the driving mechanism 500 and extrudes the cut blank by matching with the fixed die 302 to complete the forming.

It should be noted that the movement of the clamp 204 includes an active open-close mode and a passive open-close mode. The action of clamping and loosening the blank can be achieved as long as the clamping portion 2041 of the clamp 204 can match with the cutting edge 2021. The driving manners of the clamp drive device 205 include a hydraulic cylinder driving, a pneumatic cylinder driving, a mechanical driving, an electric-mechanical driving, an electromagnetic driving, a cam lever and spring driving, a blank impact and a spring returning.

The connecting lines between the swinging pivot 2042, the clamping portion 2041 and the drive end 2043 may be in the same straight line or form a triangle. As shown in FIG. 4, the connecting lines between the swinging pivot 2042, the clamping portion 2041 and the drive end 2043 form a triangle. When the drive end 2043 is driven, the clamping portion 2041 is swung around the oscillating pivot 2042 to achieve the clamping and loosening of the blank, thereby effectively clamping the blank between the shear blade 2021 and the clamping portion 2041.

In this embodiment, two implementation solutions of the positional relationship among the swinging pivot 2042, the clamping portion 2041 and the drive end 2043 are described.

Figure 5:
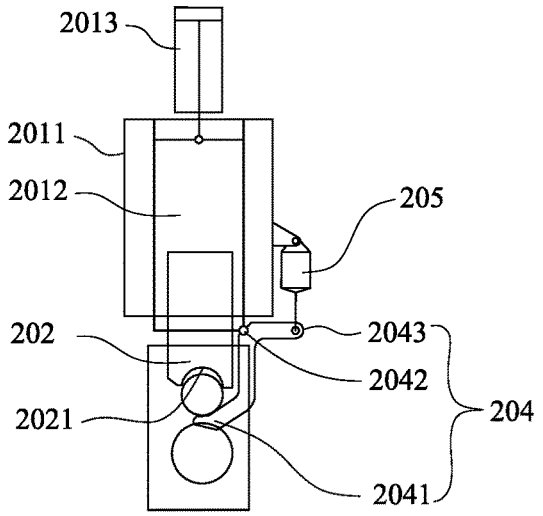
FIG. 5 is a schematic diagram showing a cutting mechanism of the hydraulic forming machine according to another embodiment of the present invention.

The first implementation solution is shown in FIG. 4, in which the drive end 2043 is arranged between the swinging pivot 2042 and the clamping portion 2041. The second implementation solution is shown in FIG. 5, in which the swinging pivot 2042 is arranged between the clamping portion 2041 and the drive end 2043. The above two implementation solutions form no limitation on the shape of the clamp 204. The structure of the clamp 204 may be various as long as the clamping portion 2041 can match with the shear blade 2021 to clamp and loosen the blank and move synchronously.

The first implementation of the clamp 204 is as follows.

Figure 6:
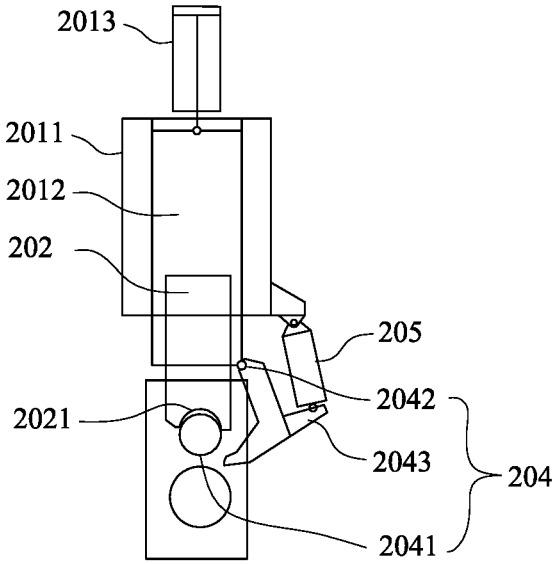
FIG. 6 is a schematic diagram showing the cutting mechanism of FIG. 4 in feeding.

1. Feeding process. As shown in FIG. 6, the clamp 204 is at a release position, that is, away from the position of the cutting blade 2021 of the shear 202. The blank freely enters the conveying inlet 2031 of the cutting die 203 and stops when it moves a distance of a fixed length.

Figure 7:
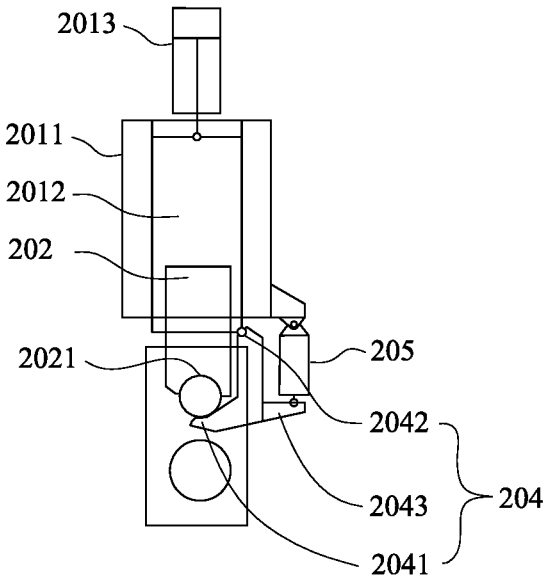
FIG. 7 is a schematic diagram showing the cutting mechanism of FIG. 4 in which the cutting begins.
Figure 8:
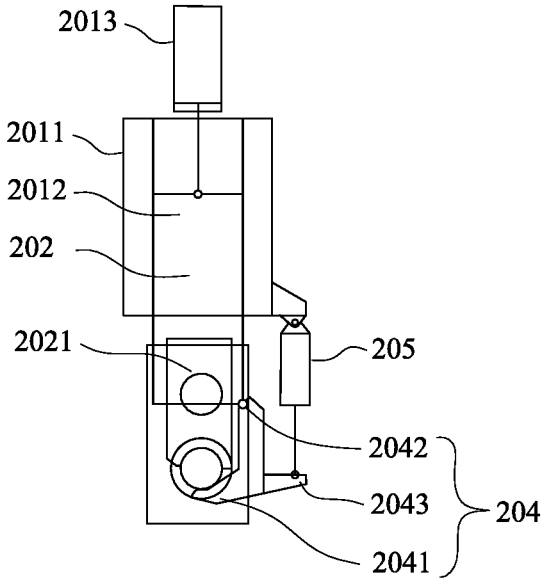
FIG. 8 is a schematic diagram showing the cutting mechanism of FIG. 4 in which the cutting ends.

2. Cutting process. As shown in FIGS. 7-8, a chamber without piston-rod of the cutting hydraulic cylinder 2013 is fed oil, and a chamber with piston-rod discharges oil. The slide block 503 of the cutting hydraulic cylinder 2013 drives the shear 202 to move towards the cutting die 203. At the same time, the clamp 204 is swung towards the cutting die 203 and clamps the blank, then moves towards the cutting die 203 together with the shear 202 until the blank is cut. The cut blank is transported from the processing space to the forming centerline between the fixed die 302 and the movable die 301 through clamping by the shear 202 and the clamp 204.

Figure 9:
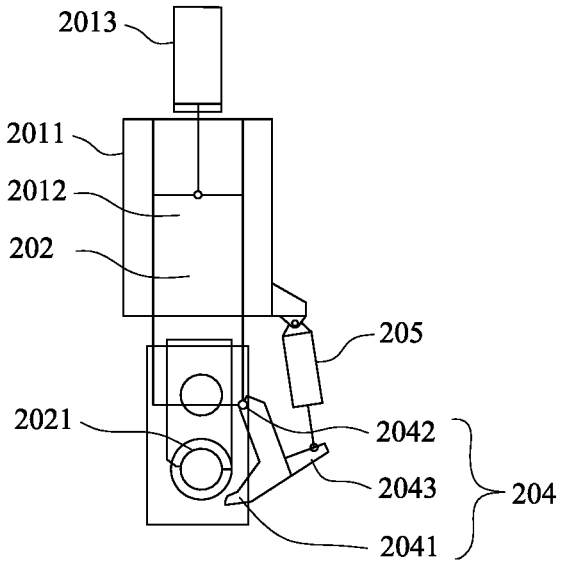
FIG. 9 is a schematic diagram showing the cutting mechanism of FIG. 4 in which the cutting resets.

3. Shear return process. As shown in FIG. 9, when the forming die 300 is moved to a certain distance and the blank is clamped in the axial direction, the clamp 204 swings away from the shear blade of the shear 202 to loosen the blank and the blank is clamped in the axial direction, such that it does not fall. At this time, the chamber with piston-rod of the cutting hydraulic cylinder 2013 is fed oil, and the chamber without piston-rod discharges oil. The slide block 503 of the cutting hydraulic cylinder 2013 drives the shear 202 to move away from the shear 202.

4. Forming process. The movable die 301 moves close to the fixed die 302 and matches with the fixed die 302 to extrude the cut blank to complete the forming. The movable die 301 is moved away from the fixed die 302 by the driving mechanism 500. At the same time, the first ejecting component 401 and the second ejecting component 402 simultaneously move relative to each other to eject the extruded product from the fixed die 302 or the movable die 301, regardless of whether the product is bonded in the movable die 301 or in the fixed die 302. The extruded product falls to the receiving device 600 by gravity and is collected by the receiving device 600, such that a processing is finished.

5. The shear 202 sequentially returns, and the clamp 204 returns together with the shear 202 during the forming process. The clamp 204 does not collide with the blank during the returning process. When the clamp 204 passes through the processing space, the blank is fed again. The cutting and forming are continuously performed in sequential cycles.

When the shear 202 are moved to the position of the forming die in the processing space, the blank are fed again. The cutting and forming are continuously performed in sequential cycles.

As shown in FIG. 4, the clamp drive device 205 drives the clamp 204 to reciprocate in a plane perpendicular to the axis of the conveying inlet 2031.

The shear 202 can reciprocate in a plane perpendicular to the axis of the conveying inlet 2031 by the cutting drive device 201. The clamp 204 and the shear 202 can be operated in the same plane. In the present embodiment, preferably, a surface of the clamp 204 close to the shear die 203 is on the same plane as a side of the shear 202 facing the conveying inlet 2031. The plane is perpendicular to the axis of the conveying inlet 2031 of the shear die 203.

In summary, compared to the ball rolling mill and the mechanical ball forging machine, the technical solution of the present embodiment has the following technical advantages.

1. The hydraulic forming machine provided by the present application has the functions of cutting, extrusion forming, ejection and receiving. The cut blank can be directly extruded, and all the processes can be completed in one time on the hydraulic forming machine.

2. The hydraulic transmission is adopted for forming, such that a large hydraulic forming force is achieved. The products have various specifications, wide applications and high quality.

3. The electro-hydraulic position closed-loop control technology is adopted in the extrusion forming stroke and cutting stroke of the hydraulic forming machine, such that the hydraulic forming machine has an accurate movement stroke, good automatic positioning and repeatability, no requirement in manual mechanical adjustment, and can produce products with good appearance consistency, high quality and good appearance.

4. The extruding yield rate is over 99%, which is 17~25% higher than the rolling yield.

5. The hydraulic transmission is adopted. The force transmission parts have self-lubricating function, no mechanical wear, accurate movement track, high equipment reliability, low failure rate and high equipment capacity.

6. The mechanical-electrical-liquid integration automatic control technology is adopted. The hydraulic forming machine has high degree of automation, less labor intensity and low labor costs.

7. The hydraulic forming machine has reasonable functional parameters, small vibration and low noise. The production is safe and meets the environment-friendly production standard and requirements of modern enterprises.

Embodiment 2

The specific implement manner of the microcrystalline copper ball automatic hydraulic forming machine provided by the present embodiment is as follows. The microcrystalline copper ball automatic hydraulic forming machine includes a feed device, a clamping device, a straightening device, a fixed-length feed device, a mainframe, a blank cutting device, a copper ball forming die device, a ball ejector, a slide component, and a hydraulic power device, a ball receiving device, a hydraulic control system and an electric control system. The feed device, clamping device, straightening device, fixed-length feed device and the mainframe are arranged on the same plane foundation. The blank cutting device, copper ball forming die device, ball ejector, slide component, hydraulic power device and the ball receiving device are installed in a frame. The hydraulic control system and electric control system are installed near the mainframe. The main technical feature is that the copper ball is formed by the metal ball forming machine by using a hydraulic power. In an embodiment, the power of the microcrystalline copper ball automatic hydraulic forming machine is provided by a hydraulic control system including a hydraulic pump station, a control valve group, a main hydraulic cylinder, a pipeline. The hydraulic pump station provides hydraulic oil with set pressure and set flow rate. The control valve group controls the main hydraulic cylinder to move according to the set direction and speed by the set program. The movable die of the copper ball forming die device is driven by the piston rod of the main hydraulic cylinder to move towards the fixed die and hydroform the blank. In an embodiment, the hydraulic control system of the microcrystalline copper ball automatic hydraulic forming machine controls or adjusts the forming force. The motions of blank feeding, clamping, straightening, fixed length feeding, blank cutting, forming and ejecting are all controlled by the hydraulic control, hydraulic proportional control or hydraulic servo control technologies. In an embodiment, the forming stroke of the microcrystalline copper ball automatic hydraulic forming machine can be rigidly limited or steplessly adjusted. In an embodiment, the forming force of the microcrystalline copper ball automatic hydraulic forming machine can be adjusted steplessly. The stepless adjustment includes manual stepless adjustment and proportional stepless adjustment. In an embodiment, the frame of the microcrystalline copper ball automatic hydraulic forming machine is a closed frame, an open frame or other form of frame. In an embodiment, the concentricity of the fixed die and the movable die of the copper ball forming die device can be steplessly adjusted within a range of 360°. In an embodiment, the fixed length can be steplessly set and adjust by the fixed-length feed device of the microcrystalline copper ball automatic hydraulic forming machine according to the diameter or volume requirement of the microcrystalline copper ball and the diameter of the blank used. The fixed-length feed device can complete the fixed length feeding motion under the control of the electrical control system and an accurate fixed length can be achieved. In an embodiment, the fixed-length feed device may adopt a fixed length feeding of a linear reciprocating feeding, a swinging reciprocating feeding or an intermittent rotating feeding, which all can steplessly adjust the feed length. In an embodiment, the linear reciprocating feeding, a swinging reciprocating feeding or an intermittent rotating feeding may be controlled and driven by a mechanical transmission, a hydraulic cylinder, a pneumatic cylinder, a motor reducer, and a servo motor and reducer, a hydraulic or pneumatic motor and other electromagnetic drive manner. In an embodiment, the blank cutting device of the microcrystalline copper ball automatic hydraulic forming machine may adopt a blank shearing manner, a blank sawing manner, blank laser cutting manner, blank plasma cutting manner or other cutting manners. In an embodiment, the blank shearing manner is completed by a blank shearing device including a fixed shearing die component, a movable shearing die component and a drive device. In an embodiment, in the blank shearing device, the movable shearing die component is driven by the drive device to move relative to the fixed shearing die component in a direction perpendicular to an axis of the fixed shearing die component to cut the copper material blank. In an embodiment, the movable shearing die component is driven by the drive device to twist around the axis of the fixed shearing die component to cut the copper material blank. In an embodiment, the foregoing two manners are combined to cut the copper material blank into segments with a certain weight and volume required to form the copper balls. In an embodiment of the present technical solution, the driving manners of the drive device of the blank shearing device includes hydraulic cylinder driving, pneumatic cylinder driving, electrical motor and mechanical transmission, hydraulic motor and mechanical transmission, and electromagnetic transmission. In an embodiment, the blank sawing manner of the automatic hydraulic forming machine for microcrystalline copper ball is completed by a blank sawing device including a sawing device, a clamping conveying mechanism. In an embodiment, the blank sawing manners include circular saw, flat saw, band saw and wire saw manners. The circular saw includes a rack saw and an abrasive disk saw. In an embodiment, the clamping conveying mechanism of the microcrystalline copper ball automatic hydraulic forming machine opens when the fixed length blank is fed and clamps the blank when the sawing is performed. The blank is conveyed to the center of the dies after the sawing is finished by conveying manners of linear motion, rotary motion or oscillating motion. In an embodiment, the fixed die and the movable die of the copper ball forming die device of the microcrystalline copper ball automatic hydraulic forming machine are all provided with an ejector including a hydraulic cylinder, a connecting mechanism and an ejection rod. The ejection rod is driven by the piston rod of the hydraulic cylinder to move outward to realize the ball ejection motion through the connecting mechanism. In an embodiment, the ejector of the microcrystalline copper ball automatic hydraulic forming machine is driven by the driving manners of mechanical transmission, hydraulic transmission, pneumatic transmission and electromagnetic transmission. In an embodiment, the clamping conveying mechanism of the microcrystalline copper ball automatic hydraulic forming machine clamps the blank and moves forward or backward during the feeding process, and releases the blank to complete the clamping and feeding work when the blank enters the fixed-length feed device. In an embodiment, the clamping manner of the clamping device is unidirectional clamping or bidirectional clamping. The driving manners of the clamping motion include mechanical transmission, hydraulic transmission, pneumatic transmission and electromagnetic transmission. In an embodiment, the microcrystalline copper ball automatic hydraulic forming machine adopts a mechanical, electrical, hydraulic and intelligent control mechanical-electrical-liquid integration fully automatic control technology to realize the automatic control and coordinated operation of the whole production process such as feeding, clamping and straightening, blank cutting, forming, ball ejection so as to achieve the purpose of fully automatic production of microcrystalline copper balls. In an embodiment, the microcrystalline copper ball automatic hydraulic forming machine adopts ethernet technology to timely collect and transmit dynamic production data and information, thereby realizing automatic control and intelligent management of microcrystalline copper ball forming production. In an embodiment of the present technical solution, the copper material blank used in the feed device of the microcrystalline copper ball automatic hydraulic forming machine is a coiled copper material blank or a straight copper material blank. In an embodiment of the present technical solution, the copper material blank is a coiled copper material blank. The feed device includes a decoiling device and a pinch device. Each coiled copper material blank is continuously decoiled and pinched to the straightening device for continuously straightening, making it a copper material blank having sufficient straightness for feeding by the fixed-length feed device. In an embodiment, the copper material blank is a straight copper material blank. The feed device includes a storage platform, a material distributing mechanism, a traverse mechanism, a conveying mechanism, a pinch device. Each straight copper material blank is distributed, traversed, conveyed, and pinched to the straightening device by the feed device. Then each copper material blank is straightened to become a copper material blank with sufficient straightness for feeding by the fixed-length feed device. In an embodiment, the straightening device of the microcrystalline copper ball automatic hydraulic forming machine adopts a two-rollers or multi-rollers straightening manner. The straightening rollers may adopt an active straightening manner and a passive straightening manner. The active straightening manner is that the straightening rollers are driven by the drive device to straighten the copper material blank. The passive straightening manner is that the copper material blank moving forward drives the straightening rollers to rotate and then is straighten by the straightening rollers. In an embodiment, the driving manners of the drive device in the straightening device include motor reducer mechanical transmission, hydraulic motor mechanical transmission, pneumatic motor mechanical transmission and electromagnetic transmission. In an embodiment of the present technical solution, the copper material blank is a coiled copper material blank and placed on the decoiling device. Each coiled copper material blank is continuously decoiled by the decoiling device and pinched to the straightening device through the pinch device for continuous straightening, making it a copper material blank with sufficient straightness for feeding by the fixed-length feed device. In an embodiment, the copper material blank is a straight copper material blank and placed on the storage platform. Each straight copper material blank is respectively transported to the traverse mechanism by the material distributing mechanism, traversed to the conveying mechanism by the traverse mechanism, conveyed to the pinch device by the conveying mechanism and pinched to the straightening device by the pinch device for continuous straightening, making it a copper material blank with sufficient straightness for feeding by the fixed-length feed device. In an embodiment of the present technical solution, the copper material blank is fed to the blank cutting device by the fixed-length feed device according to the set blank length and cut by the blank cutting device by a shearing manner or a sawing manner. The copper material blank of the fixed length is clamped to the center of the copper ball forming die device by the clamping conveying mechanism. In an embodiment, the electric control system controls the hydraulic pump station to provide hydraulic oil having a set pressure and flow rate. The control valve group controls the main hydraulic cylinder to operate according to the set direction and speed by the set program. The slide component is driven by the piston rod of the main hydraulic cylinder to drive the movable die of the copper ball forming die device to move towards the fixed die, such that the copper material blank of the fixed length is hydroformed. In an embodiment, the movable die is driven by the main hydraulic cylinder to return to the initial position after the forming of the copper ball is finished. A left ball ejector and right ball ejector simultaneously eject during the returning process of the movable die, and the copper ball falls into the receiving device and is then collected to complete a copper ball forming. In an embodiment, the microcrystalline copper ball automatic hydraulic forming machine includes the hydraulic power device, the ball receiving device, the hydraulic control system, the electric control system. The feed device, clamping device, straightening device, fixed-length feed device and the mainframe are arranged on the same plane foundation. The blank cutting device, copper ball forming die device, ball ejector, slide component, hydraulic power device and the ball receiving device are installed in the frame. The hydraulic control system and the electric control system are installed in the control cabinet. The main technical feature is that the microcrystalline copper ball is formed by a hydraulic power. Compared to the existing copper ball forming technology and equipment, the technical solution has the following advantages. The hydraulic transmission is adopted for forming, such that a large hydraulic forming force is achieved. The products have large specifications, a high quality, a compact core structure and a smooth appearance. The microcrystalline copper balls are the high-end products. The main hydraulic cylinder is used for providing the power, such that the forming force of the copper ball can be adjusted steplessly and the copper ball products have wide specifications. The displacement sensor is used to detect the forming stroke, such that the forming stroke is controlled accurately and can be adjusted steplessly. The annular stripes on product can be evenly controlled and the product has a smooth appearance. The center of the movable die of the copper ball forming die device can be steplessly adjusted within a range of 360°. The concentricity of the fixed die and the movable die is accurate. The dies have a good stress state and a long service life. The product has a round and normal appearance. The fixed length of the blank can be set and adjusted steplessly. The fixed length feeding motion is completed under the control of the electric control system, such that the fixed length of the blank is accurate and the quality of the copper ball product is uniform. The hydraulic control system adopts proportional servo control technology, which can conveniently adjust the hydraulic forming force, forming speed and forming stroke by PLC according to the specification of the product, so that the equipment resources can be reasonably used and the equipment capacity can be optimally used. The mechanical-electrical-liquid integration automatic control technology is adopted. The hydraulic forming machine has high degree of automation, high product quality, high extruding yield, safe and reliable operation, low production cost and high equipment capacity. The ethernet technology is adopted to collect and transmit dynamic production information in time to realize automatic control and intelligent management of microcrystalline copper ball forming production. The technical solution has novel principles, advanced technology, intelligent management, reasonable structure, reliable operation, high automation level, high equipment productivity and the products are environment-friendly and high-end.

The above are only the preferred embodiments of the present invention and are not intended to limit the present invention. Various modifications and changes can be made to the present invention by those skilled in the art. Any modifications, equivalent substitutions, improvements, etc.

made within the spirit and principle of the present invention should be included within the scope of the present invention.

What is claimed is:

1. A hydraulic forming machine, consisting of:

a body, a cutting mechanism, a forming die, an ejector, and a driving mechanism; wherein the body is provided with at least one first mounting surface; the forming die comprises a movable die and a fixed die matched with each other; the ejector comprises a first ejecting component arranged at a side of the movable die and a second ejecting component arranged at a side of the fixed die;

the body is provided with a feed inlet penetrating the first mounting surface; the cutting mechanism and the fixed die are provided on the first mounting surface of the body and respectively at two sides of a discharge end of the feed inlet; the movable die is arranged on the driving mechanism and configured to be driven by the driving mechanism to move close to or away from the fixed die in a direction perpendicular to the first mounting surface; a blank cut by the cutting mechanism is configured to be extruded between the fixed die and the movable die;

the cutting mechanism comprises a cutting drive device, a shear, a cutting die, a clamp and a clamp drive device; the shear is provided with a shear blade; the clamp is provided with a clamping portion; a swinging pivot and a drive end; and the cutting drive device comprises a guide mechanism, a cutting slide block and a cutting hydraulic cylinder;

the cutting die is provided on the first mounting surface and provided with a conveying inlet arranged concentrically with the feed inlet; a processing space is provided at an output end of the conveying inlet; the shear is configured to be driven by the cutting drive device to reciprocate in a plane perpendicular to an axis of the conveying inlet;

the clamping portion of the clamp is configured to be driven by the clamp drive device to move close to or away from the shear blade;

an end of the clamp drive device is connected to the drive end of the clamp; the other end of the clamp drive device is connected to the guide mechanism; and the clamp drive device is configured to drive the clamp to swing around the swinging pivot and move with the cutting slide block;

when the shear is driven by the cutting drive device to move toward the processing space and the clamping portion of the clamp is driven by the clamp drive device to move close to the shear blade, the blank is able to be clamped by the shear blade and the clamping portion; the shear and the clamp together with the blank are able to synchronously move downward under the drive of the cutting drive device and the clamp drive device respectively to a centerline between the fixed die and the movable die and shear the blank during the moving;

the guide mechanism is vertically provided on the first mounting surface and at a side of the cutting die; an axial direction of the guide mechanism is perpendicular to an extending direction of the axis of the conveying inlet;

the cutting slide block is configured to be slidably engaged with the guide mechanism; the cutting slide block is movable with respect to the guide mechanism along the axial direction of the guide mechanism; the swinging pivot is hinged to an end of the cutting slide block close to the cutting die; and the shear is arranged on the end of the cutting slide block close to the cutting die; and the cutting hydraulic cylinder has a piston rod; the cutting slide block has a top and a bottom along the axial direction of the guide mechanism; the top of the cutting slide block is away from the cutting die, and the bottom of the cutting slide block is close to the cutting die; and the piston rod is connected to the top of the cutting slide block.

2. The hydraulic forming machine of claim 1, wherein the driving mechanism comprises a main hydraulic cylinder; the body is provided with at least one second mounting surface parallel to the first mounting surface; the main hydraulic cylinder is provided on the second mounting surface of the body; an axis of a piston rod of the main hydraulic cylinder is perpendicular to the second mounting surface; an end of the piston rod of the main hydraulic cylinder faces the first mounting surface.

3. The hydraulic forming machine of claim 2, wherein the driving mechanism further comprises a slide component arranged between the first mounting surface and the second mounting surface; the slide component comprises a slide block, a first rail and a second rail; two sides of the slide block are respectively slidably engaged with the first rail and the second rail; and the piston rod of the main hydraulic cylinder is connected to one end of the slide block, the movable die and the first ejecting component are arranged on the other end of the slide block.

4. The hydraulic forming machine of claim 3, wherein the body is configured for the mounting of all of the cutting mechanism, the forming die, the ejector, the slide block and the main hydraulic cylinder.

5. The hydraulic forming machine of claim 1, wherein the hydraulic forming machine further comprises a hydraulic control system and an electrical control system.

* * * * *